United States Patent [19]

Drennan

[11] Patent Number: 4,518,446

[45] Date of Patent: May 21, 1985

[54] METHOD OF MAKING BEVELLED GLASS WINDOW

[75] Inventor: Frank E. Drennan, Etobicoke, Canada

[73] Assignee: Dor Seal Limited, Toronto, Canada

[21] Appl. No.: 553,099

[22] Filed: Nov. 18, 1983

Related U.S. Application Data

[63] Continuation-in-part of Ser. No. 258,060, Apr. 28, 1981, abandoned.

[51] Int. Cl.[3] ..... B44C 5/08

[52] U.S. Cl. ..... 156/63; 52/308; 52/311; 52/455; 52/788; 156/99; 156/182; 156/212; 156/278; 156/292; 428/38; 428/78

[58] Field of Search ..... 156/63, 212, 99, 278, 156/182, 292, 299, 196; 52/311, 788, 455, 308; 428/38, 78

[56] References Cited

U.S. PATENT DOCUMENTS

| | | | |
|---|---|---|---|
| 676,122 | 6/1901 | Byrnes | 52/311 |
| 1,524,998 | 2/1925 | Russell | 156/63 |
| 3,420,730 | 1/1969 | Ellefson | 156/63 |
| 4,068,441 | 1/1978 | Shaffer | 52/308 |
| 4,154,880 | 5/1979 | Drennan | 428/38 |

*Primary Examiner*—John J. Gallagher

*Attorney, Agent, or Firm*—Fetherstonhaugh & Co.

[57] ABSTRACT

A method of making a leaded came type window wherein the basic window pane is continuous, the ornamental lites are laminated to the basic pane, the ornamental lites are of substantial thickness, and the came is a channel member with its edges conformed to the marginal areas of the lamination. The came is conformed by placing it over a spline on a table, the spline having the depth of the channel and the configuration of the ornamentation; and the table having the surface of the window and then pressing the edges of the came to conform them to the table. After removal from the table it is applied to the laminated ornamental pane.

2 Claims, 12 Drawing Figures

METHOD OF MAKING BEVELLED GLASS WINDOW

The application is a continuation-in-part of application Ser. No. 06/258,060 filed Apr. 28, 1981, now abandoned.

FIELD OF INVENTION

This invention relates to a method for making a window that has one face ornamentally divided into a plurality of lites by a channelled came secured thereto with an adhesive contained in the channel wherein at least one of the lites has laminated thereto a sheet of decorative material such as a piece of polished glass with a bevelled edge or a piece of glass with an ornamentally roughened surface.

DESCRIPTION OF PRIOR ART

Windows with a surface ornamentally divided into a plurality of lites that are separated by a came are in high demand. The conventional manner of making a leaded glass window wherein the individual lites are separately cut and joined by a came is not sufficiently weatherproof for modern architectural requirements in outside windows. Leaded windows cannot be made sufficiently air-tight by conventional methods to form a panel of a multipanel insulated window wherein separate sheets of glass spaced apart by a spacer form an insulating air space between the sheets. A conventionally formed leaded pane will leak air and permit moisture to enter between the sheets of such an insulated window. Any method that joins separate pieces lacks sufficient strength to maintain air tight characteristics. U. S. Pat. No. 4,068,441 to B. J. Shaffer shows such a construction of this prior use.

Proposals for making a strong window with a surface divided into a plurality of differently ornamented lites have been proposed but they do not envisage anything that is of the order of a leaded came as a separation for the lites and the aesthetic affect is very short of a leaded came window.

The structural requirement is that the basic window be one piece and continuous for strength. U.S. Pat. No. 3,420,730 to H. B. Ellefson discloses a window pane with thin decorative overlays secured at their marginal edges to the window with a tape. It is a simulated stained glass window but the simulation is very apparent. The overlay has a thickness of about 1/1000 of an inch and the metalic lead tape that secures the overlay to the pane has a thickenss of about 22/1000 of an inch. The physical proportions of the tape do not approach the proportions of a came and the aesthetic affect is not there. The objective of an ornamental window is aesthetics and this structure just does not have them. It is an inexpensive imitation of a stained glass window but it does not have the essential characteristics of a stained glass window.

Prior U.S. Pat. No. 4,154,880 to F. E. Drennan discloses a came of special construction that can be applied to a window the surface of which is flat. The resulting window is strong because the basic pane is continuous and the channel shaped came has the proportions of a conventional came used to join separate pieces. However, the entire surface of the window is flat. The affect would be very much improved if the elevation of the window could vary from one decorative lite to another to give the idea of a lite with bevelled edges or a lite with a roughened surface different from its adjacent lites.

The mere use of the thin laminated decorative pieces of U.S. Pat. No. 3,420,730 would not give the desired affect because they have no depth. They could not be bevelled, nor could they have an ornamented surface. If the decorative area of the laminations of U.S. Pat. No. 3,420,730 were made of substantial thickness the thin tape used as a marginal decoration would not work. Moreover, the came arrangement shown in U.S. Pat. No. 4,154,880 could not be used because that particular came must be used as disclosed in that patent on a flat piece of glass. There is no provision in the came of Drennan U.S. Pat. No. 4,154,880 for a difference in elevation between the lites that are separated by the came. This is the limitation of U.S. Pat. No. 4,154,880 that prevents the teachings thereof from being applied to a lite that is a lamination where the lamination is of substantial thickness, say at least $\frac{1}{8}$ of an inch.

The bevelled glass affect cannot be achieved with the teachings of U.S. Pat. Nos. 3,420,730 and 4,068,441.

Other attempts have been made to achieve a bevelled affect, but not by laminating and a channelled came with its sides set to conform to the differences of elevation between adjacent lites. U.S. Pat. No. 4,068,441 shows a pane of glass made from bevelled separate pieces and held together by a plastics material simulated came that is moulded into position. It has the aesthetic affect but it lacks the strength of a continuous pane as a backing.

SUMMARY OF INVENTION

This invention, by manipulation of the sides of the came, provides a decorative window pane that gives a bevelled or decorative leaded glass window affect that is strong and of pleasing appearance.

This invention provides a method for making a leaded glass window wherein selected lites are laminated with a lamination of substantial thickness and channelled came is caused to overlay the marginal portions of the laminated lite and the adjacent lite.

The invention makes it possible to produce a leaded glass window of new and improved aesthetic affect that meets modern architectural requirements for a strong window.

A method according to the invention of making a glass or like window having a face wherein the face of the window is ornamentally divided into a plurality of lites by came secured thereto, the undersurface of the came being formed with an open channel for adhesive to secure the came to the face of the window, comprises the steps of forming splines on a jig surface in the configuration of said plurality of lites; piecing said channeled lead came over said splines, the splines entering the channels; said splines having a height to engage with the bottoms of the channels in the came; joining the pieces of came at their intersections; laminating the area of at least one of said lites on the face of said window with a sheet of decorative material having a thickness of at least $\frac{1}{8}$ of an inch whereby the area so laminated is elevated from the plane face of the window; forming said jig surface at the marginal areas adjacent each side of said splines to duplicate in elevation the marginal areas of the lites on said face of said window; pressing said came against the jig surface by placing a rigid board laminated with a resilient sheet over the jig surface with the resilient sheet in contact with the came, pressing the board against the jig surface to compress the resilient sheet against the came to force the bottom of the channelled came against the spline and turn the sides of the channelled came to conform the edges of the channel of the came to the elevation of the jig surface at the marginal areas to the splines; removing said came from said splines with its underside so conformed and depositing an adhesive in the channels of the came; aligning the configuration of the came to the configuration of the lites on the face of the window so that the came overlies the boundaries between the lites; and pressing the window and the came together to adhesively secure the came to the window. In the drawings:

DESCRIPTION OF PREFERRED EMBODIMENT

Figure 1:
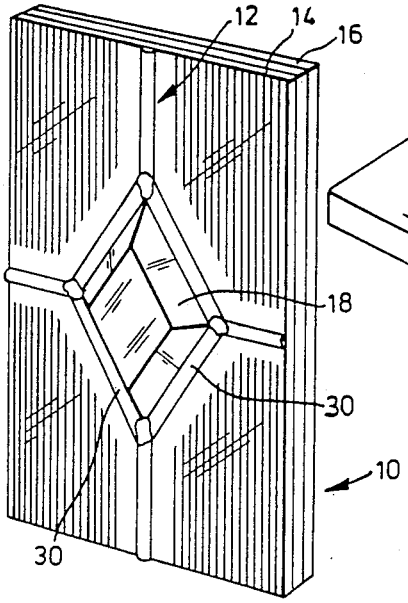
FIG. 1 is an illustration of a lead came ornamental window.

In the drawings, the numeral 10 generally refers to a glass window, one face of which is ornamentally divided into a plurality of lites by lead came generally indicated in FIG. 1 by the numeral 12. The window illustrated is a sealed unit made up of two spaced apart sheets of glass 14 and 16 spaced and sealed at their edges by spacers. Windows made in this fashion are commonly used because of their heat insulation characteristics. This invention is not limited to the ornamenting of such windows with a lead came configuration. It can also be used with advantage on a single sheet of glass. However, it is of special use with the double pane insulated construction because it is not possible to provide an ornamented lead came window of good appearance that has good insulating characteristics with the conventional lead came method. The leaded ornamental window illustrated in the drawings has as its base sheet of glass one of the two sheets of glass that make up the window unit 10. An ornamental overlay sheet of glass 18 is laminated to the sheet 14 and a lead came 30 is bonded to the base sheet with its edges extending over the marginal portions of the ornamental bevel on the overlay 18 and over the base sheet 14. The ornamental overlay 18 has its edges bevelled by a glass gringind process and is adhesively secured at its edges to the sheet 14 by means of a peripherally extending bead of waterproof adhesive 22 such as a quick drying epoxy. Once thus secured one cannot discern the laminated nature of the assembly. The glass appears to be a single piece of glass and the adhesive seals the space between the two glass surfaces.

The lamination will commonly be about $\frac{1}{4}$ inch thick and the bevelled marginal area will be about $\frac{1}{8}$ inch thick near its edge. These dimensions can vary but it is intended that the thickness of the lamination be at least $\frac{1}{8}$ inch at its centre area.

The came is secured to the glass with a polysulphide adhesive that is contained within the channel thereof and that is, when set, mechanically interlocked with the came at the inwardly directed flanges at the edges of the came. This particular kind of union as explained in U.S. Pat. No. 4,154,880 is a permanent one capable of withstanding weather. It will be noted that the polysulphide overlays the epoxy to ensure a good weather seal.

Figure 10:
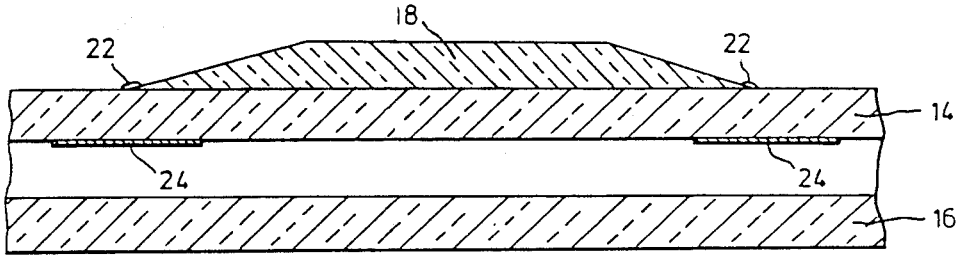
FIG. 10 is an illustration along the line 10—10 of FIG. 9.

Preferably the pane of glass is formed with a ribbon paint overlay that is silk screened and oven baked as indicated at numeral 24 on FIG. 10 in the pattern of the came on the opposite side to the side that the came is applied for the purpose of hiding the adhesive when the window is viewed from the opposite side to the side of the came. This ribbon is substantially the same colour as the came and has a pleasing visual effect.

In result, the window of FIG. 1 is a leaded came window, one lite of which appears to be a diamond configuration with its side edges bevelled, an effect which was only achievable prior to this invention by separately forming the individual lites and securing them together by means of a conventional H-shaped came.

While a diamond shaped lite with its edges bevelled has been illustrated in the drawings, it is not intended that the invention should be limited to such a design. One could, for example, form the particular lite with a glass lamination of any desired special artistic characteristics in respect of colour, finish, etc.

In order to make the window illustrated in FIG. 1, one first assembles an insulated plain glass unit that consists of the panes 14 and 16 and the spacer element between them. It is usual to provide a moisture absorbing substance between the panes that dries the air between them. The general construction of these units is well known and not part of this invention. As noted above, the pane 14 has deposited thereon a strip of paint material 24 in the configuration of the lead came of the finished window so that the underside of the lead came will not be visible when one looks through the pane 16 of the window. This deposit is made before the window is assembled.

Figure 2:
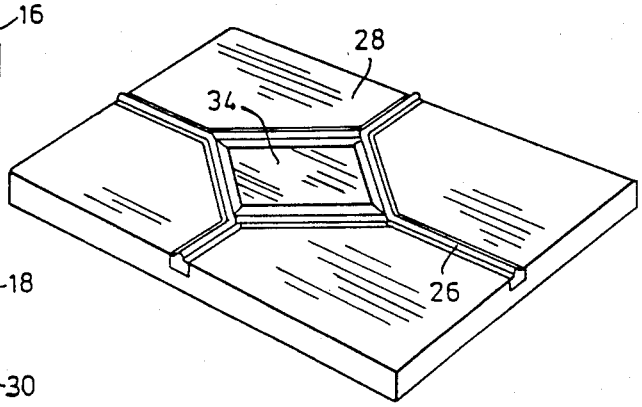
FIG. 2 is an illustration of splines formed on a table in the configuration of the came for the ornamental window.
Figure 4:
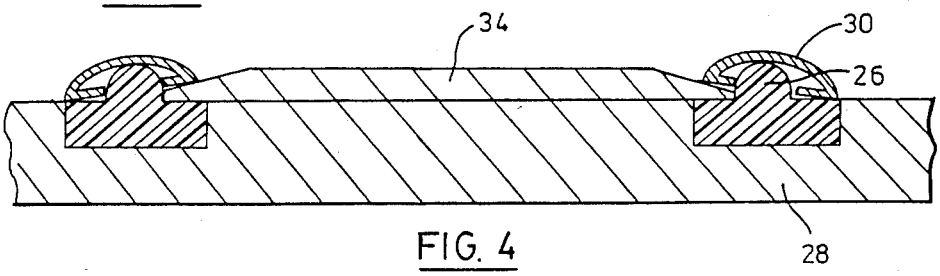
FIG. 4 is an illustration along the line 4—4 of FIG. 3.

The next step in the process is to mount a spline 26 in a channel of a table surface 28 in the configuration of the lead came of the finished window. (FIG. 2) The cross-section of a suitable spline is seen in FIG. 4. It is preferably made from a hard plastics material and is fitted into a channel in the table to provide an upstanding spline over which the channelled came 30 can be placed. (FIG. 4)

Figure 3:
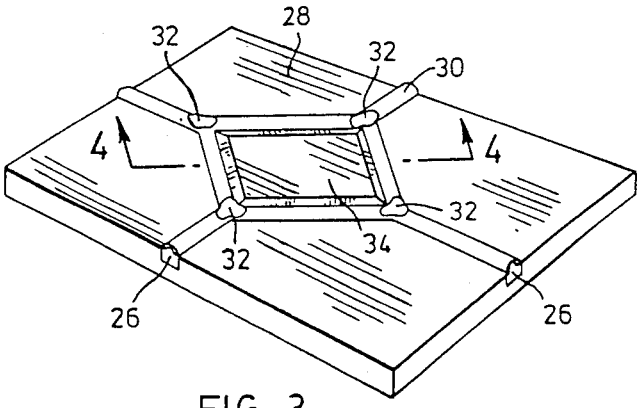
FIG. 3 is an illustration of the table of FIG. 2 with lead came formed over the splines.

Came 30 is made of came lead alloy by an extrusion process and lengths of the came are pieced together over the entire spline 26. The joints in the pieces of came are soldered as at 32. (FIG. 3)

The area of the table corresponding to the diamond of the ground bevelled piece of glass 18 has an insert 34 mounted therein which is designed to raise the marginal portions thereof above the general level of the table by an amount substantially equal to the increased thickness of the finished window caused by the laminated ornamental overlay 18.

The table or jig on which the splines 26 are mounted conforms in elevation to the window surface to which the came is to be applied but as is apparent from FIG. 4 the edges of the channel of the came do not at this stage complement the jig. The disposition illustrated in FIG. 4 will vary along the length of the came, and the came will not be in uniform contact with the surface of the jig table longitudinally of the came.

After the came has been fitted to the spline and the joints have been soldered the came is pressed against the table by means of a pressing board generally indicated by the numeral 36 to conform the edges of the channelled came to the elevation of the jig surface at the marginal areas of the splines. (FIG. 5) The jig surface at the marginal areas to the splines now duplicate in elevation the marginal areas of the lites in the finished window. It will be noted that the splines engage the bottoms of the channels of the channelled came.

It will be noted that the spline 26 is of an elevation to extend to the bottom of the came. (FIG. 4) The pressing operation of FIG. 4 is to press the came against the jig but mere pressure against the bottom of the came will not achieve the result because lead has practically no resiliency. The thing that is needed is a downward force on the side portion of the came channel that will urge them inwardly and downwardly against the jig table.

To achieve this pressing board 36 is lined with a resilient rubber pad 38 over the came table 28. The assembly of pressing board 36, resilient rubber pad 38 and table 28 are passed through a roller press. The pressure of the roller press compresses the rubber pad against the came and the compressed rubber reasserts itself in the areas over the sides of the channel of the came and in so doing forces the edges of the channel against the table surface and into conformity therewith to achieve the result similar to that indicated in FIG. 5 for the full longitudinal extent of the cames.

The rubber 38 must have a resilience such that when compressed in the roller press it will exert a reaction against the sides of the channel member and force them against the spline table to achieve conformity with the surface elevation thereof. A medium stiff rubber pad 38 about $\frac{3}{8}$ inch thick on a one inch thick ply wood board 36 has worked well. The proportions of FIG. 5 do not accurately represent this particular board. Other designs will be apparent to those skilled in the art given the result to be achieved. A roller press has proved to be the best kind of a press because with such a press one can achieve high pressing pressures between the rigid table 28 and board 36 locally at the location of the rolls as the boards are passed through rollers. It is not necessary that the pressure be exerted simultaneously over the whole area of the board and table.

The splines 26 maintain the height of the came and the rubber pad through its resilience levels the edges of the came.

It will be appreciated that the drawings are illustration only and not to scale.

In use, a rubber pad having a thickness of about $\frac{5}{8}$ inch and a durometer softness of about 60 has worked very well with a lead came having a width of about 5/16 of an inch at its base and a height of about $\frac{1}{8}$ of an inch.

Figure 5:
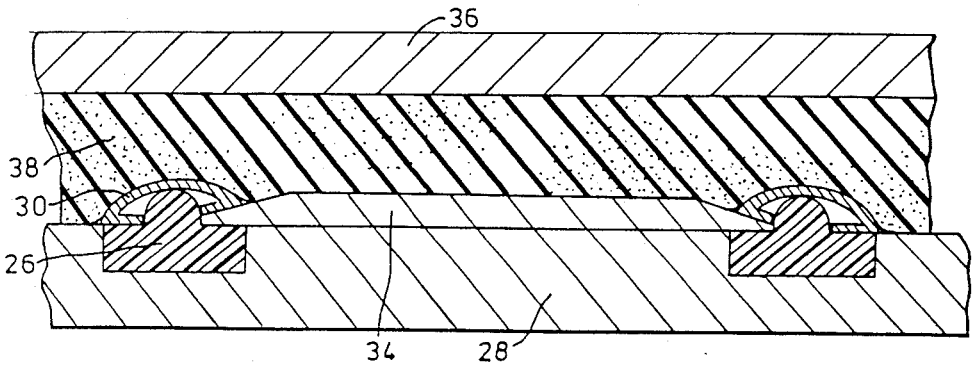
FIG. 5 is an illustration similar to FIG. 4, but showing the step of pressing the came against the table to straighten the edges thereof.
Figure 6:
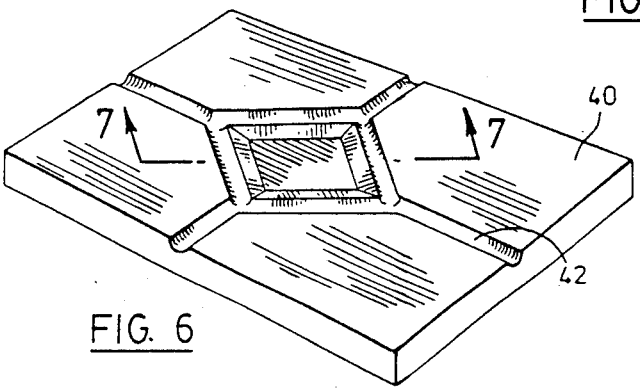
FIG. 6 is an illustration of a jig for retaining the came that has been formed on the table of FIG. 2 as it is united with a pane of glass.
Figure 7:
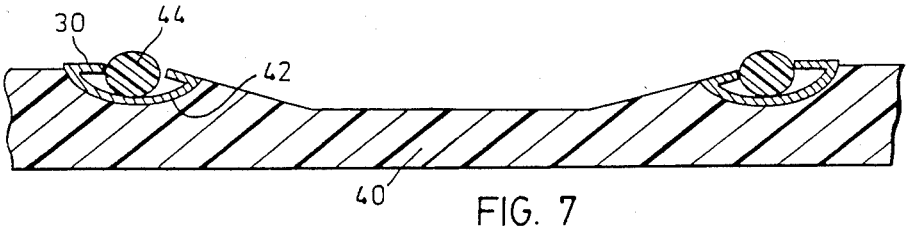
FIG. 7 is an illustration along the line 7—7 of FIG. 6, but with the came located therein.
Figure 8:
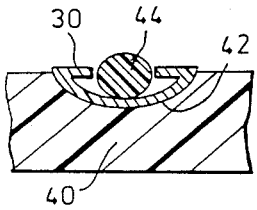
FIG. 8 is an illustration similar to FIG. 7 but along the line 8—8 of the jig of FIG. 6.

After the came has been conformed on the table top 28 as illustrated in FIG. 5 it is removed and adhesive is deposited into the channel of the came and the glass window is pressed against the came to adhesively secure the came to the glass. This operation can be facilitated by means of the table 40 (FIG. 6) that is cut with channels 42 to receive the came. FIG. 7 is a cross-sectional illustration along the line 7—7 of FIG. 6 and shows the disposition of the came at the diamond section. FIG. 8 is an illustration along the line 8—8 and shows the disposition of the came at the line 8—8. It will be recalled that in the pressing operation the area at the location of FIG. 8 was not raised on either side of the came in FIG. 3 so that both sides of the channel at the section 8—8 are of the same elevation.

The numeral 44 is an indication of a bead of adhesive which is applied along the length of the came on the table 40. This adhesive is a polysulphide of known characteristics suitable for adhering the came to the glass.

Figure 9:
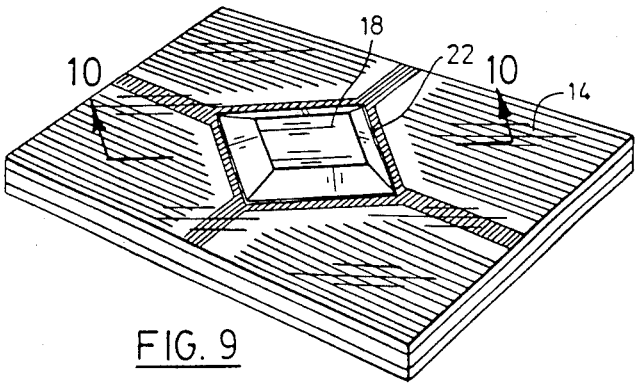
FIG. 9 is an illustration of a window with a bevelled diamond shaped piece of glass laminated to the base pane.
Figure 11:
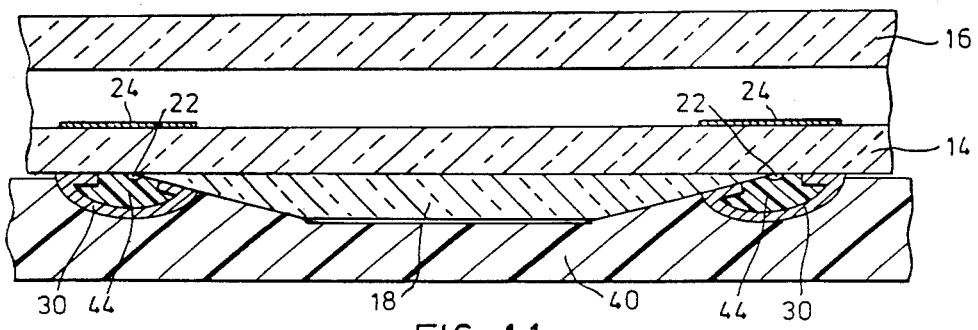
FIG. 11 is an illustration showing the laminated window in the area of the diamond overlay as it is applied to the came in the jig.

The glass window pane 14 with the diamond section 18 laminated thereto (FIG. 9) is then applied to the came with the overlay 24 thereon aligned with the came as indicated in FIG. 11 and pressed against the adhesive. It will be noted that the table 40 is formed with a depression to accommodate the diamond shaped lamination 18.

Figure 12:
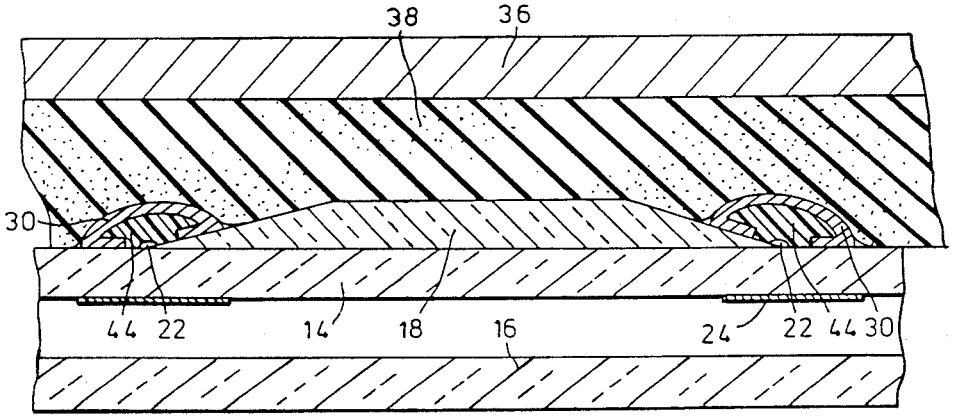
FIG. 12 is an illustration of a final pressing operation.

The window 10 is then removed from the table 40 together with the came which has been adhered thereto and placed with the came in an upward position in the press following which the press platen is caused to decend thereon to complete the levelling of the edges of the came with the surface of the window and secure the assembly in final position for complete setting of the adhesive as shown in FIG. 12.

The adhesive 44 cures in a period of about five hours after pressing following which the unit can be cleaned to remove excess polysulphide squeezed in the pressing operation to render the unit ready for use.

The laminated pieces of glass have substantial thickness and require the herein described method for completion into a window.

Embodiments of the invention other than the one illustrated will be apparent to those skilled in the art.

What I claim as my invention is:

1. A method of making a glass or like window having a face wherein the face of the window is ornamentally divided into a plurality of lites by came secured thereto, the undersurface of the came being formed with an open channel for adhesive to secure the came to the face of the window, comprising the steps of:

forming splines on a jig surface in the configuration of said plurality of lites;

piecing said channeled lead came over said splines, the splines entering the channels;

said splines having a height to engage with the bottoms of the channels in the came;

joining the pieces of came at their intersections;

laminating the area of at least one of said lites on the face of said window with a sheet of decorative material having a thickness of at least $\frac{1}{8}$ of an inch whereby the area so laminated is elevated from the plane face of the window;

forming said jig surface at the marginal areas adjacent each side of said splines to duplicate in elevation the marginal areas of the lites on said face of said window;

pressing said came against the jig surface by placing a rigid board laminated with a resilient sheet over the jig surface with the resilient sheet in contact with the came, pressing the board against the jig surface to compress the resilient sheet against the came to force the bottom of the channelled came against the spline and turn the sides of the channelled came to conform the edges of the channel of the came to the elevation of the jig surface at the marginal areas to the splines;

removing said came from said splines with its underside so conformed and depositing an adhesive in the channels of the came;

aligning the configuration of the came to the configuration of the lites on the face of the window so that the came overlies the boundaries between the lites; and pressing the window and the came together to adhesively secure the came to the window.

2. The method of claim 1 wherein the sheet of decorative material that is laminated to an area of said lites is bevelled at its marginal edges.

* * * * *